US007823490B2

(12) United States Patent
Evans et al.

(10) Patent No.: US 7,823,490 B2
(45) Date of Patent: Nov. 2, 2010

(54) CUTTING SEQUENCE FOR NET TRIMMING A COMPOSITE LAYUP AT AN OBLIQUE ANGLE

(75) Inventors: Richard B. Evans, Maple Valley, WA (US); John Heigl, Apache Jct., AZ (US)

(73) Assignee: The Boeing Company, Chicago, IL (US)

( * ) Notice: Subject to any disclaimer, the term of this patent is extended or adjusted under 35 U.S.C. 154(b) by 226 days.

(21) Appl. No.: 11/542,225

(22) Filed: Oct. 4, 2006

(65) Prior Publication Data

US 2008/0083308 A1 Apr. 10, 2008

(51) Int. Cl.
*B26D 3/02* (2006.01)

(52) U.S. Cl. ..... 83/39; 83/581; 83/956

(58) Field of Classification Search ..... 83/581, 83/864, 873, 877, 878, 956, 935, 951, 39
See application file for complete search history.

(56) References Cited

U.S. PATENT DOCUMENTS 4,516,451 A * 5/1985 Takeshita et al. ..... 83/171
4,969,380 A * 11/1990 Halligan ..... 83/877
5,195,410 A * 3/1993 Young ..... 83/13
5,273,601 A * 12/1993 Sergel et al. ..... 156/133
5,746,102 A * 5/1998 Benzing et al. ..... 83/34
6,058,823 A 5/2000 Michoud
6,170,478 B1 1/2001 Gorder
6,562,436 B2 5/2003 George et al.
6,575,064 B2 * 6/2003 Hart et al. ..... 83/16
6,689,448 B2 2/2004 George et al.
6,709,538 B2 3/2004 George et al.
6,755,105 B2 * 6/2004 Downing ..... 83/175

OTHER PUBLICATIONS

American GFM Corporation, "US-50—6 Axis Ultrasonic Cutter," available at <http://www.agfm.com/Cutting/3D_Cutting.htm.> last visited Apr. 13, 2009.

T. J. Mason et al. "Applied Sonochemistry," Chapter 1, Section 1.3.4-Engineering Applications—Cutting, pp. 13-14, available at <http://books.google.com/books?id=LhNiLd6U9bYC&pg=PA13&lpg=PA13&dq=ultras onic+cutting+crack+propagation&source=bl&ots=-P7hvUe8ov&sig=aMrUy1nlywM4A83NamfTI2phrSg&hl=en&ei=3Pc7SrWKHY6OsgPZiMGFCw&sa=X&oi=book_result&ct=result&resnum=8>, last visited Jun. 19, 2009.

Lucas et al. "A finite element model for ultrasonic cutting," Ultrasonics, vol. 44, Supplement 1, Dec. 22, 2006, pp. e503-e509, Proceedings of Ultrasonics International (UI'05) and World Congress on Ultrasonics (WCU).

* cited by examiner

*Primary Examiner*—Kenneth E. Peterson

(57) ABSTRACT

To generate a bevel in an uncured composite layup, an edge of part cut through the composite layup is performed at about 90° relative to the composite layup and a bevel cut is performed on the edge of part.

19 Claims, 3 Drawing Sheets

CUTTING SEQUENCE FOR NET TRIMMING A COMPOSITE LAYUP AT AN OBLIQUE ANGLE

FIELD OF THE INVENTION

The present invention generally relates to a device and method of cutting composite material. More particularly, the present invention pertains to a method of net trimming a layup of composite ply material at an oblique angle and a device for doing so.

BACKGROUND OF THE INVENTION

Composite structures are typically constructed from multiple layers or plies. These plies may include a variety of materials such as carbon fiber, various other fibers, metal foils, and the like. In addition, the plies may be pre-impregnated with a resin and are often dispensed from a roll or spool. Typically, multiple plies are applied, one upon another, sometimes in multiple directions, to generate a "layup" of the composite item. This layup or "preform" is generally built up within a mold or over a form. Often, the plies are slightly oversized to ease the layup process. Depending upon the materials utilized and post-layup procedures that may be performed, any excess composite material is cut from the layup before or after the layup is cured.

Depending upon the particular application, it may be preferable to remove any excess composite material before the layup is cured. A disadvantage associated with conventional methods of cutting uncured composite layup is that a cutting blade may adhere to the layup and drag the composite material out of position. The use of ultrasonic cutting blades reduces the tendency of the blade to bind the resin, however, for relatively thick layups or when cutting at an angle, conventional ultrasonic blades adhere to the layup at an unacceptable rate.

Accordingly, it is desirable to provide a layup cutting device and cutting method that is capable of overcoming the disadvantages described herein at least to some extent.

SUMMARY OF THE INVENTION

The foregoing needs are met, to a great extent, by the present invention, wherein in some embodiments a method of cutting a bevel in an uncured composite layup is provided.

An embodiment of the present invention relates to a method of generating a bevel in an uncured composite layup. In this method, an edge of part cut through the composite layup is performed at about 90° relative to the composite layup and a bevel cut is performed at the edge of part.

Another embodiment of the present invention pertains to a method of cutting an uncured layup of up to 20 composite plies. In this method, a periphery of the composite layup is cut using an ultrasonic knife oriented vertically relative to the layup. The ultrasonic knife is controlled to penetrate into a supporting substrate on which the layup is supported. In addition, a bevel is cut along the periphery using the ultrasonic knife. The bevel cutting ultrasonic knife is controlled to cut away a scrap material without penetrating the supporting substrate.

Yet another embodiment of the present invention relates to a method of cutting an uncured layup of more than 20 composite plies. In this method, a periphery of the layup is cut along using an ultrasonic knife oriented vertically. The ultrasonic knife is controlled to penetrate below a supporting substrate on which the layup is supported. In addition, an intermediate cut is cut into the layup using the ultrasonic knife oriented vertically. The intermediate cut is cut relatively inside the periphery and at a predetermined depth above a nominal bevel surface. Furthermore, a bevel is cut on the layup using the ultrasonic knife. The bevel is cut in a single pass controlling the bevel cutting ultrasonic knife to sever a scrap material disposed relatively above the nominal bevel surface and controlling the bevel cutting ultrasonic knife to not penetrate the supporting substrate.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

The present invention provides, in an embodiment, a method of net trimming or cutting a composite layup at an oblique angle. The composite layup or preform cut by this method include, at least, composite materials such as unidirectional tapes, fabrics, foils, and/or films that have been pre-impregnated with a resin "prepreg" and/or composite materials that have been otherwise bound or tacked together. In this embodiment, a sequence of cuts is performed that reduces drag upon a cutting blade. That is, resistance and adherence of the layup to the blade is reduced. By reducing drag, movement of the plies relative to other plies in the layup is reduced and bending force or deflection of the blade is reduced. In this manner, the sequence of cuts performed according to an embodiment of the invention increases accuracy of the final cut and minimizes disturbance of the layup, thereby, increasing production, reducing production cost, and decreasing waste associated with unacceptable movement of the layup during cutting.

Figure 1:
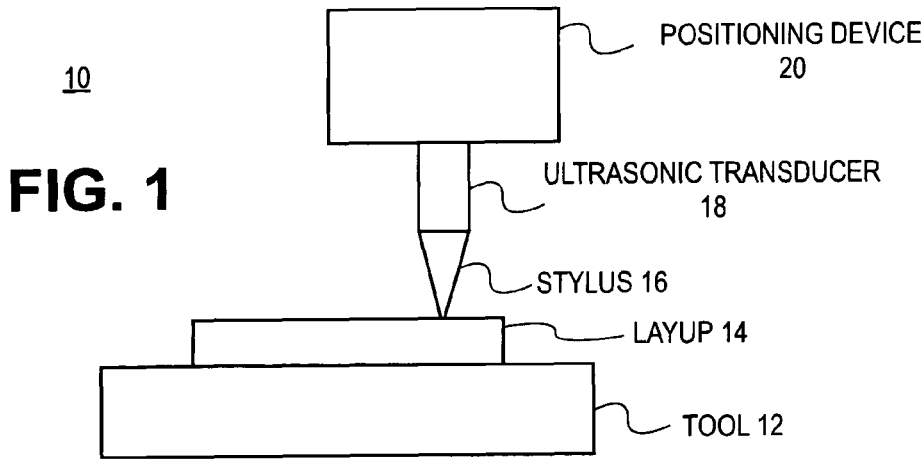
FIG. 1 is simplified view of a cutting system according to an embodiment of the invention.

The invention will now be described with reference to the drawing figures, in which like reference numerals refer to like parts throughout. As shown in FIG. 1, a cutting system 10 includes a tool 12, layup 14, stylus 16, ultrasonic transducer 18, and positioning device 20. The tool 12 optionally provides a mold upon which the layup 14 may be placed. In other embodiments, the layup 14 may be generated on a mold or mandrel and subsequently disposed upon the tool 12 for cutting. The tool 12 provides a surface upon which the layup 14 may be cut. In this regard, the tool 12 may serve as an anvil and the tool 12 and the stylus 16 are juxtaposed in co-operative alignment to facilitate cutting layup 14. That is, the tool 12 provides supporting substrate for the layup 14 and thereby facilitates the cutting action of the stylus 16.

The stylus 16 includes any suitable cutting, scoring, and marking device. Depending upon the material to be cut and/or the particular application, the ultrasonic transducer 18 is optionally included to facilitate cutting the layup 14. For example, some composite material utilized to fabricate the layup 14 may be difficult to cut without vibrational energy supplied by the ultrasonic transducer 18. When cutting such materials, the ultrasonic transducer 18 is preferably included. When utilized, the ultrasonic transducer 18 is configured to impart vibrational energy upon the stylus 16. The stylus 16, when thusly energized, may generate a crack front in the layup 14 that proceeds the stylus 16 and facilitates cutting.

The positioning device 20 moves or positions the stylus 16 relative to the layup 14. In various embodiments, the positioning device 20 includes a head or stylus orientation assembly to rotate the stylus 16 about one or more axes. The positioning device 20 may also include a gantry, robotic armature, X-Y table, or the like to move the stylus 16 relative to the layup 14. Movement of the stylus 16 relative to the layup 14 may be controlled in any suitable manner.

Figure 2:
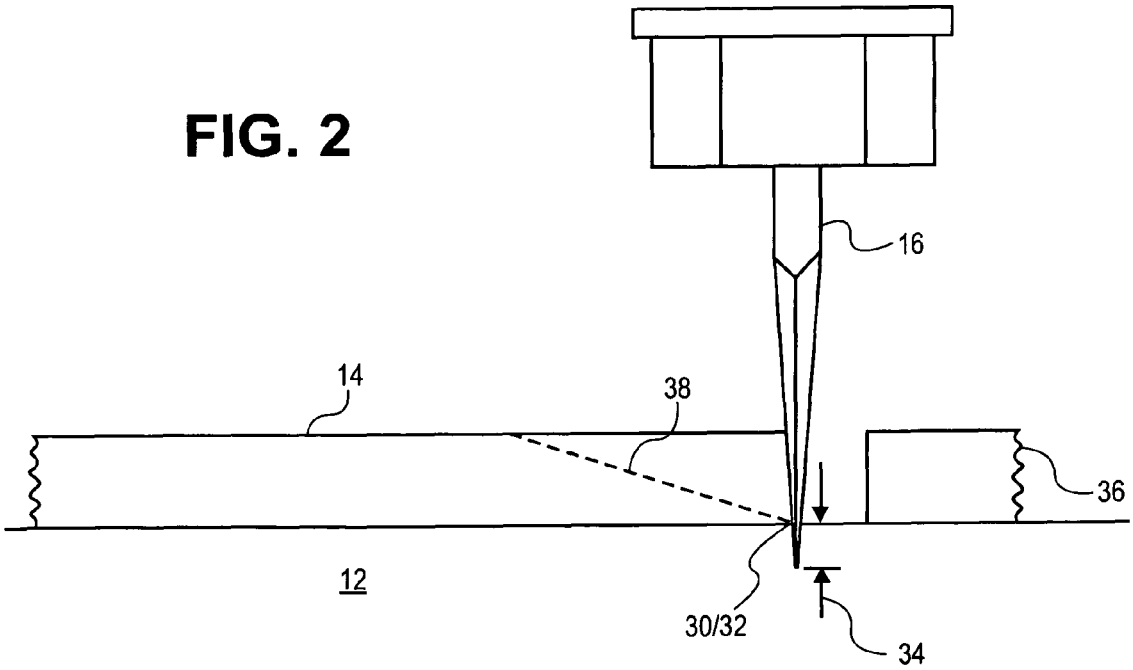
FIG. 2 is an cross-sectional view of the cutting system during a first cut in a sequence of cuts performed according to an embodiment of the invention.
Figure 3:
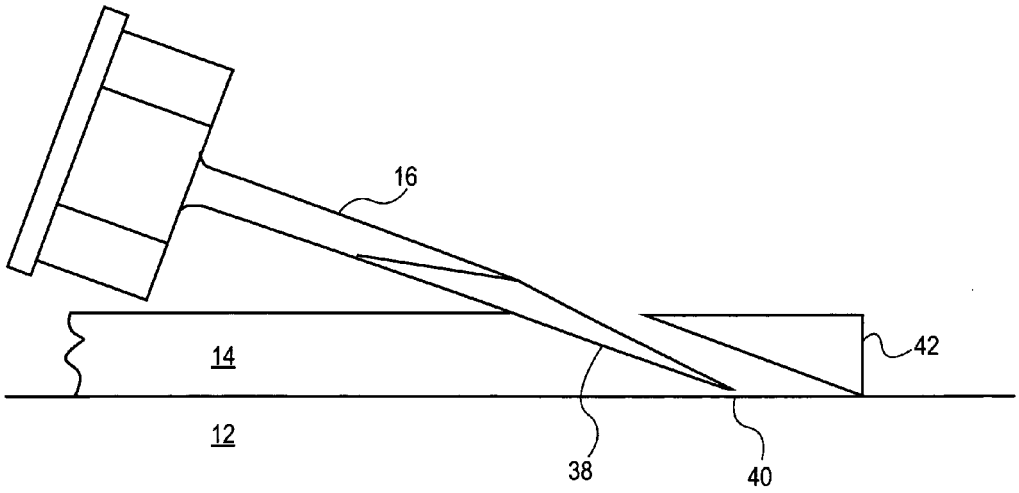
FIG. 3 is an cross-sectional view of the cutting system during a second cut in a sequence of cuts performed according to an embodiment of the invention.

An embodiment of the present invention pertains to a method of cutting an uncured layup of up to about 20 composite plies. In a specific example of this method, a periphery of the composite layup is cut with the stylus 16 (e.g., an ultrasonic knife, or the like) oriented vertically relative to the layup 14. The stylus 16 is controlled to penetrate up to 0.05 inches (1.27 mm) into the tool 12 or other such supporting substrate on which the layup 14 is supported. In addition, as shown in FIG. 3, a bevel is cut along the periphery using the stylus 16 oriented at about 18° to about 21° relative to the layup. The bevel cutting stylus 16 is controlled to cut away a scrap material without penetrating the tool 12. FIG. 2 is an cross-sectional view of the cutting system 10 during a first cut in a sequence of cuts performed according to an embodiment of the invention. As shown in FIG. 2, the stylus 16 is a dual bevel blade. The stylus 16 is controlled to cut the layup 14 to an edge-of-part ("EOP") 30 that defines a final, outside or periphery dimension, of a composite part or item. Accordingly, a cut along the EOP 30 may be described as a periphery cut 32. To fabricate the part, the layup 14 is typically generated with a perimeter slightly beyond the EOP 30 and then cut along the EOP 30. To facilitate cutting at the EOP 30, it may be preferable to perform the periphery cut 32 with the stylus 16 oriented at essentially 90° to the layup 14. In this manner, the stylus 16 may cut through a relatively minimum amount of the layup 14. In addition, as the incident angle of the cut deviates from 90°, deviations in the surface height of the tool 12 may produce deviations from the EOP 30 of the cut. By performing the periphery cut 32 at about 90°, this type of deviation may be reduced.

According to an embodiment, while performing the periphery cut 32 the stylus 16 is controlled to penetrate or cut slightly below a bottom surface of the layup 14 to generate an overcut 34. The overcut 34 facilitates separation of a scrap 36 from the layup 14. In general, the depth of the overcut 34 may be about 0.0 inch (0.0 mm) to about 0.1 inches (2.54 mm). In a particular example, the depth of the overcut 34 is about 0.05 inches (1.27 mm). In another example, the actual depth of the overcut 34 is about 0.03 inches (0.76 mm) given a Z offset of about 0.02 inches (0.50 mm) and setting for the 90° cut of about 0.05 inches (1.27 mm). To reduce wear or damage to the stylus 16, the tool 12 may include a resilient material such as, for example, ultra high molecular weight (UHMW) polyethylene polymers, Delrin®, Vyon® nylon, acetal; and the like. These and other materials may sustain many hundreds or thousands of cuts without undue wear.

In some applications, one or more uncured parts are affixed and co-cured to fabricate a unitary or one piece item. In a particular example, the layup 14 includes a stringer that is a component of an aircraft fuselage. To improve material properties of the completed fuselage, the stringer and barrel are co-cured. To increase an amount of contact area between the stringer and the barrel, the EOP 30 of the layup 14 may be cut at a bevel 38.

Unfortunately, bevel cutting the EOP 30 has several disadvantages. For example, as the cutting angle departs from perpendicular (90°), the length of a cutting edge of the layup 14 in contact with the stylus 16 increases. As this cutting edge length increases, resistance increases. The increased resistance may result in stylus deflection, out of tolerance trimming, layup movement, increased wear of the cutting system, slower feed rates, and the like.

The stylus deflection may be exacerbated by bending forces experienced by the stylus 16. In this regard, cutting at about 90° tends to balance resistance encountered by each side of the stylus 16 and thus, reduce torquing forces experienced by the stylus 16. As the incident angle of the stylus 16 deviates from 90°, the torquing forces may increase. In addition, cuts made into upper surface of the tool 12 at oblique angles may induce premature degradation of the tool 12. This condition may be exacerbated due to the incident angle of the stylus 14. That is, to generate the overcut 34 at a predetermined depth, a greater length of the stylus 16 will penetrate the tool 12 when the stylus 16 is at an oblique angle. In a particular example, to generate the overcut 34 at a depth of 0.05 inches (1.27 mm) and a stylus angle of 22°, about 0.14 inches (~3.49 mm) of the stylus 16 may cut into the tool 12. Furthermore, this oblique cut may generate a flap in the surface of the tool 12 that may tend to raise an edge and/or break off.

FIG. 3 is an axial view of the cutting system 10 during a second cut in a sequence of cuts performed according to an embodiment of the invention. As shown in FIG. 3, the stylus 16 is controlled to perform a bevel cut 40 to cut the layup 14 at an oblique angle. The bevel cut 40 generates the bevel 38 and a relatively small scrap 42. The scrap 42 has relatively less mass than the combined mass of the scrap 36 and the scrap 42 and therefore provides relatively less resistance to the stylus 16. It is an advantage of embodiments of the invention that ramp or bevel cuts may be performed in uncured composite layups at less than 21° to about 18°. It is another advantage that these bevel cuts may be performed in layups with greater than 20 composite plies Preferably, the stylus 16 is controlled to essentially cut at or slightly above an intersection of the EOP 30 and the tool 12 and substantially on or parallel to the bevel 38. If the stylus 16 cuts relatively below the intersection of the EOP 30 and the tool 12, a loss in continuity of the EOP 30 may result as the bevel cut may proceed relatively to the inside of the EOP 30. To avoid potential loss in continuity of the EOP 30, the stylus 16 may be controlled to cut relatively above the intersection of the EOP 30 and the tool 12. In a particular example, the stylus 16 may be controlled to cut about 0.01 inches (0.25 mm) above the intersection of the EOP 30 and the tool 12. In another example, the stylus 16 may be controlled to cut essentially at the intersection of the EOP 30 and the tool 12. In actual practice, given a Z offset above the tool 12 of 0.02 inches (0.50 mm) and assuming an approximate downward blade deflection of 0.0005 inches (0.13 mm), the tip of the stylus 16 may, in fact, be about 0.015 inches (0.37 mm) above the surface of the tool 12.

As shown in FIG. 3, the stylus 16 utilized to generate the bevel 38 optionally includes a single bevel edge profile. The single bevel edge profile, if utilized, may facilitate cutting the bevel 38. It is an advantage of embodiments of the invention, that by first cutting the EOP 30 in an essentially perpendicular stylus orientation (as shown in FIG. 2) and then generating the bevel 38 (as shown in FIG. 3), the EOP 30 is more precisely cut. It is another advantage that wear on the stylus 16 is reduced. It is yet another advantage that wear on the tool 12 is reduced.

Figure 4:
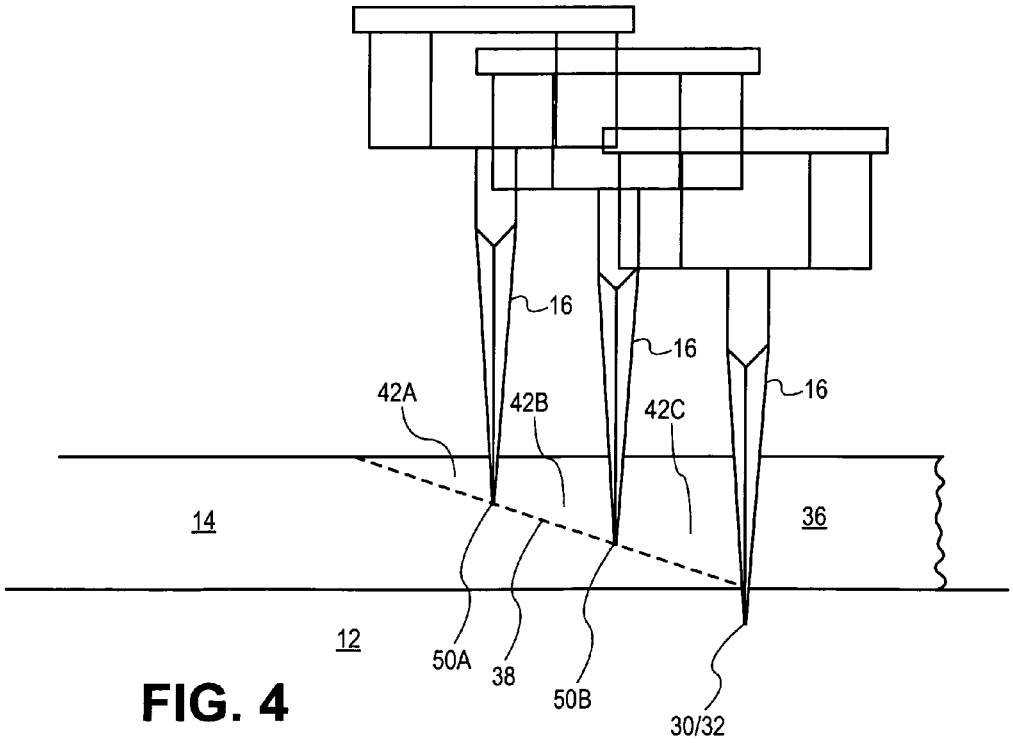
FIG. 4 is an cross-sectional view of the cutting system illustrating a series of cut in a sequence of cuts performed according to another embodiment of the invention.

As shown in FIG. 3, the bevel 38 and corresponding bevel cut 40 are at an angle of about 18° relative to the tool 12. However, in other examples, the bevel 38 and corresponding bevel cut 40 need not be at 18°, but rather, may be at any suitable angle. Suitable bevel angles include, at least, 16°, 19°, 22° or greater with the surface of the tool 12, and the like, An embodiment of the present invention relates to a method of cutting a relatively thick uncured layup of more than about 20 composite plies. In a specific example of this method, a periphery of the layup 14 is cut with the stylus 16 oriented vertically. The stylus 16 is controlled to penetrate up to 0.05 inches below the tool 12 or other such supporting substrate on which the layup 14 is supported. In addition, as shown in FIG. 4, one or more intermediate cuts are cut into the layup using the stylus 16 oriented vertically. These intermediate cuts are cut relatively inside the periphery and at a predetermined depth above a nominal bevel surface. Furthermore, as shown in FIG. 3, a bevel is cut on the layup 14 using the stylus 16 oriented at 18 to 21 degrees relative to tool 12. In a particular example, the bevel is cut in a single pass controlling the stylus 16 to penetrate about to an intersection between the nominal bevel surface and the periphery to sever a scrap material disposed relatively above the nominal bevel surface and controlling the bevel cutting stylus 16 to not penetrate the tool 12. FIG. 4 is an cross-sectional view of the cutting system 10 making a series of perpendicular cuts in a sequence of cuts performed according to another embodiment of the invention. As shown in FIG. 4. the series of perpendicular cuts include one or more intermediate cuts 50 and the periphery cut 32. Depending upon a variety of factors, the intermediate cuts 50 may improve cutting performance. These factors may include, for example, layup thickness, composite material properties, bevel 38 angle, empirical results, and the like. For example, when bevel cutting a relatively thick layup 24 at a relatively shallow bevel 38, the scrap 42 cut from the layup 14 may resist release or removal. Examples of relatively shallow bevel 38 angles include angles of about 14° to about 18° relative to the surface of the tool 12. The intermediate cuts 50 subdivide the scrap 42 into a plurality of scrap 42*a* to 42*n*. Due to the reduction in cross-sectional area, each of the scrap 42*a* to 42*n* has less rigidity and offers less resistance to release than the undivided scrap 42.

In the particular example shown, two intermediate cuts 50*a* and 50*b* are shown. However, any suitable number of intermediate cuts 50*a* to 50*n* are included in embodiments of the invention. To perform the intermediate cuts 50*a* and 50*b*, the stylus 16 is controlled to cut at or just above the bevel 38 (e.g., a nominal bevel surface). Cutting slightly above the nominal bevel surface reduces the likelihood that the intermediate cuts 50*a* to 50*n* may score the nominal bevel surface. In a particular example, the stylus 16 is controlled to cut about 0.01 inches (0.25 mm) above the nominal bevel surface. To perform the periphery cut 32, the stylus 16 is controlled to cut essentially at the EOP 30. Preferably, the stylus 16 is further controlled to generate the overcut 34.

In various embodiments, the perpendicular cuts may be performed in any suitable order. For example, the periphery cut 32 may be performed first, followed be intermediate cut 50*b*, then 50*a*. Alternatively, intermediate cut 50*a* may be performed first, followed by 50*b*, and then followed by the periphery cut 32. In addition, some or all of the cuts 50*a*, 50*b*, and 32 may be performed at essentially the same time.

To generate the bevel 38, the stylus 16 may be controlled to perform the bevel cut 40 as shown in FIG. 3. In a particular example, following the series of perpendicular cuts shown in FIG. 4, the bevel cut 40 may be performed. In another example, the bevel cut 40 may be performed in a series of steps. More specifically, during or following the intermediate cut 50*a*, a bevel cut 40*a* may cut along a portion of the bevel 38 up to or slightly beyond the intermediate cut 50*a*. Similarly, additional bevel cuts may be performed to correspond to intermediate cuts 50*b* to 50*n*. The height of a final bevel cut performed to correspond to the periphery cut 32 is controlled to be at or slightly above the tool 12 to avoid damage to the tool 12 and/or cutting inside of the EOP 30.

Figure 5:
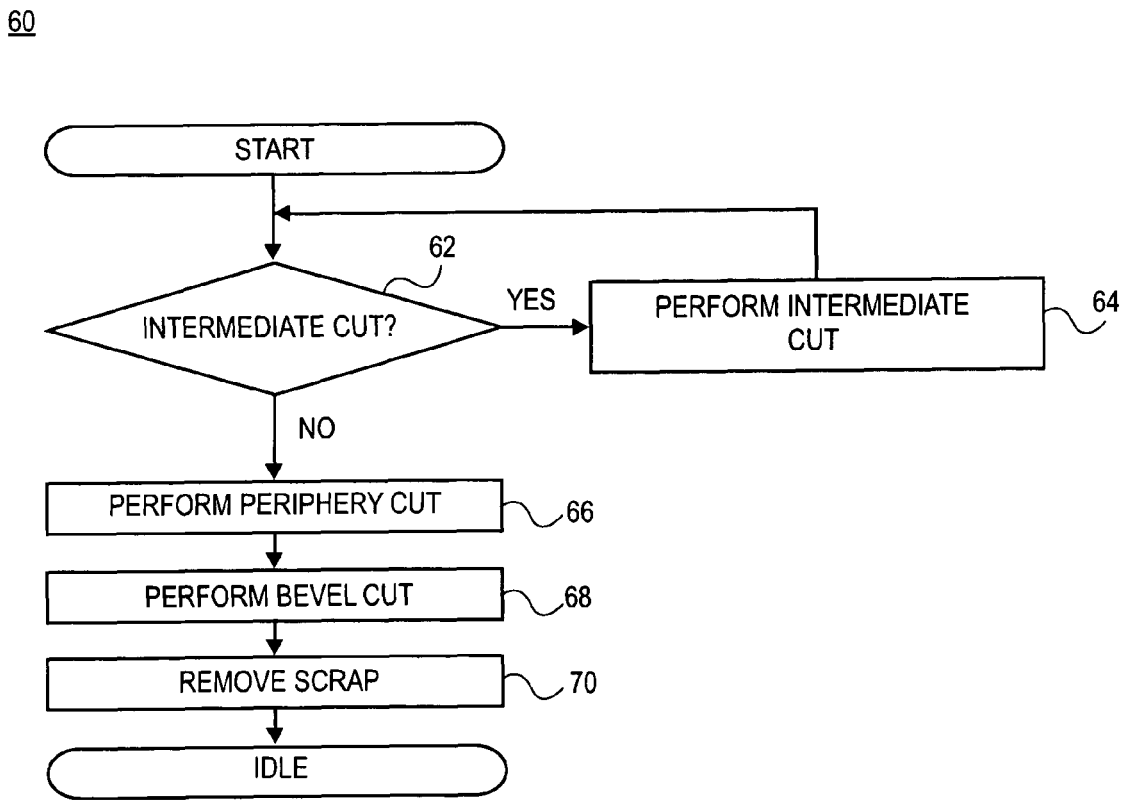
FIG. 5 is a flow diagram for a method of cutting a layup according to an embodiment of the invention.

FIG. 5 is a flow diagram for a method 60 of cutting a layup according to an embodiment of the invention. Prior to initiation of the method 60, a variety of preparative operations may be performed. For example, a composite item may be designed, a layup corresponding to the item may be generated, the cutting system 10 may be powered, the stylus 16 may be oriented, and the like. In addition, depending upon the cutting operation, a stylus may be selected and installed in the cutting system 10. In a particular example, to perform vertical cuts, a symmetric or dual bevel knife may be selected. In another example, to perform the bevel cut, a single bevel knife may be selected. The selected knife may be optimized to cut while being excited by an ultrasonic transducer 18 or horn. In yet another example, a rotary knife may be selected to perform one or more cutting operations.

At step 62, it is determined whether one or more of the intermediate cuts 50*a* to 50*n* is to be performed. For example, if the layup 14 is relatively thick, the bevel relatively shallow, and/or the composite materials relatively difficult to cut, it may be determined that one or more intermediate cuts 50*a* to 50*n* may be performed at step 64. If it is determined that the intermediate cuts 50*a* to 50*n* may be omitted, the periphery cut 32 may be performed at step 66.

At step 64, the one or more intermediate cuts 50*a* to 50*n* may be performed. For example, as shown in FIG. 4, the stylus 16 is controlled to cut at or just above the bevel 38 (e.g., a nominal bevel surface). In various embodiments, the intermediate cuts 50*a* to 50*n* may be performed before, during or after the periphery cut 32.

At step 66, the periphery cut 32 may be performed. For example, as shown in FIG. 2, the stylus 16 is controlled to cut the layup 14 essentially along the periphery or EOP 30 of the layup 14.

At step 68, the bevel cut 40 may be performed. For example, the positioning device 20 is controlled to position the stylus 16 to cut along the bevel 38. In various embodiments, the bevel cut 40 may be performed as a single cut that generates the bevel 38 or as two or more bevel cuts 40*a* to 40*n* that may be performed along with or alternating with the step 64 and/or step 66. The bevel cut 40 may be performed at any suitable angle. Suitable angles include, for example, about 15° to about 85° relative to an upper surface of the layup 14. More particularly, the bevel cut is performed at about 16° to about 25° relative to an upper surface of the layup 14. More particularly yet, the bevel cut is performed at about 18° to about 21° relative to an upper surface of the layup 14.

At step 70, the scrap 36, 42, and/or 42*a* to 42*n* may be removed. For example, the scrap 36, 42, and/or 42*a* to 42*n* may be blown, drawn, or swept away. In various embodiments, the scrap may be removed as it is generated or at the completion of the cuts. Following the step 70, the cutting system 10 may idle or stop until another cutting operation is performed.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method of generating a bevel in an uncured composite layup of 20 plies or less of impregnated composite material, the method comprising:

performing an edge of part cut through the uncured composite layup of 20 plies or less of impregnated composite material at about 90° relative to the composite layup, said edge of part cut being controlled to penetrate into a supporting substrate on which the composite layup is supported; and performing a bevel cut of the edge of part such that the bevel cut intersects the edge of part at about an intersection of the edge of part and said substrate supporting the composite layup, the composite layup being supported by the substrate on opposing sides of the bevel cut, the substrate having an upper surface defining no more than one plane, the bevel cut being performed without penetrating the plane of the upper surface of the supporting substrate, said bevel cut being angled at less than approximately 45° relative to said upper surface.

2. The method according to claim 1, further comprising:

performing the bevel cut at an angle that is generally parallel with the bevel.

3. The method according to claim 1, wherein the bevel cut is performed at about 16° to about 25° relative to the composite layup.

4. The method according to claim 1, wherein:

the bevel cut is performed using at least one of the following: a rotary knife, a dual bevel knife.

5. The method according to claim 1, wherein the overcut penetrates about 0.05 inches (1.27 mm) into the supporting substrate.

6. The method according to claim 1, wherein the bevel cut intersects the edge of part above the intersection of the edge of part and a lower surface of the composite layup.

7. The method according to claim 1, wherein:

the bevel cut is performed by exciting a knife with an ultrasonic transducer.

8. The method according to claim 1, wherein a single bevel blade is utilized to perform the bevel cut.

9. The method according to claim 1 wherein the bevel cut is performed using a stylus, the method further comprising:

performing the bevel cut at an angle that is generally parallel with the bevel.

10. The method according to claim 9, further comprising:

offsetting the stylus in a manner that a blade of the stylus has a downward deflection.

11. A method of cutting an uncured layup of 20 plies or less of impregnated composite material, the method comprising:

cutting an edge of part that defines a periphery of the uncured layup of 20 plies or less of impregnated composite material using an ultrasonic knife oriented vertically relative to the layup, the ultrasonic knife being controlled to penetrate into a supporting substrate on which the composite layup is supported; and cutting a bevel along the periphery using the ultrasonic knife such that the bevel intersects the edge of part at about an intersection of the edge of part and the supporting substrate, the composite layup being supported by the substrate on opposing sides of the bevel cut, the substrate having an upper surface defining no more than one plane, the bevel cutting ultrasonic knife being controlled to cut away a scrap material without penetrating the plane of the upper surface of the supporting substrate, said bevel cut being angled at less than approximately 45° relative to said upper surface.

12. The method according to claim 11, further comprising:

performing the bevel cut at an angle that is generally parallel with the bevel.

13. The method according to claim 12 wherein the ultrasonic knife is configured as a stylus, the method further comprising:

offsetting the stylus in a manner that a blade of the stylus has a downward deflection.

14. The method according to claim 11, wherein:

the bevel cut is performed using at least one of the following: a rotary knife, a single bevel knife, a dual bevel knife.

15. The method according to claim 11, further comprising:

controlling the ultrasonic knife to penetrate up to 0.05 inches (1.27 mm) into the supporting substrate while cutting the periphery.

16. The method according to claim 15, further comprising:

controlling the ultrasonic knife to orient at about 18° to about 21° relative to the composite layup while cutting the bevel. 17.

17. The method according to claim 15, wherein a first ultrasonic knife is utilized to cut the periphery and a second ultrasonic knife is utilized to cut the bevel.

18. The method according to claim 17, wherein the second ultrasonic knife is a single bevel blade.

19. The method according to claim 11, wherein the bevel cut is performed at about 16° to about 25° relative to the composite layup.

* * * * *